United States Patent [19]

Krynock

[11] 4,391,374

[45] Jul. 5, 1983

[54] METHOD OF AND APPARATUS FOR SEPARATING ELONGATED ARTICLES BY LENGTH

[75] Inventor: Robert A. Krynock, Indiana, Pa.

[73] Assignee: FMC Corporation, Chicago, Ill.

[21] Appl. No.: 308,297

[22] Filed: Oct. 5, 1981

[51] Int. Cl.[3] ..... B07C 5/02

[52] U.S. Cl. ..... 209/540; 209/682; 209/920

[58] Field of Search ..... 209/540, 541, 542, 545, 209/680, 682, 659, 920; 198/348, 382, 394

[56] References Cited

U.S. PATENT DOCUMENTS 3,269,534 8/1966 Clark et al. ..... 209/682

FOREIGN PATENT DOCUMENTS 80181 1/1951 Netherlands ..... 209/682

1268554 3/1972 United Kingdom ..... 209/682

*Primary Examiner*—Allen N. Knowles

*Attorney, Agent, or Firm*—Ronald C. Kamp; Richard B. Megley

[57] ABSTRACT

A separator including a vibratory surface having a transverse slot and a plate positioned within the slot to form a grading gap. The plate is mounted independent of said surface so that articles conveyed by said surface are decelerated before reaching the grading gap and the downstream edge of the slot has a lip inclined downward at the angle of vibration of the vibratory surface.

10 Claims, 5 Drawing Figures

METHOD OF AND APPARATUS FOR SEPARATING ELONGATED ARTICLES BY LENGTH

BACKGROUND OF THE INVENTION

1. Field of the Invention

This invention relates to an apparatus for and a method of separating elongated articles of random length, into articles of at least minimum length and articles of less than minimum length. More specifically, this invention concerns separating broken ears of corn less than four inches in length, known as nubbins, from whole ears of corn, on a high-speed conveyor line at a food processing plant.

2. Description of the Prior Art

Known separators have conveying surfaces with grading openings therein, which allow whole ears of corn to pass over the openings, while nubbins fall by gravity through the openings. Such graders limit the capacity for processing corn on a conveyor line because at high speed, nubbins tend to jump the grading opening instead of falling by gravity through the opening. When the conveying surface is that of a vibratory feeder, the location of the grading opening varies with the vibratory stroke. Such movement of the grading opening can result in inaccurate grading and inefficient separation.

SUMMARY OF THE INVENTION

A separator has a vibratory surface with a slot therein extending transversely of a direction of travel for elongated articles that move longitudinally thereon. A plate projects within the slot near an upstream edge thereof to form a surface over which the articles slide. A grading gap is defined between a downstream edge of the plate and a downstream edge of the slot, and articles of short length fall by gravity through the grading gap. The plate is mounted independently of the vibratory surface. Articles conveyed by the surface decelerate when sliding across the plate before reaching the grading gap.

Elongated articles of random length are separated into articles of at least minimum length and articles of less than minimum length by a method that includes the steps of supporting random length articles on a vibratory surface having a grading gap therein, vibrating the vibratory surface to move the articles thereon towards the grading gap at a predetermined speed, orienting and aligning the articles lengthwise in the direction of travel in at least one single file row, decelerating the articles from the predetermined speed of travel before the articles of minimum length to pass over the grading gap, and causing articles of short length to drop by gravity through the grading gap.

DESCRIPTION OF THE PREFERRED EMBODIMENT

Figure 1:
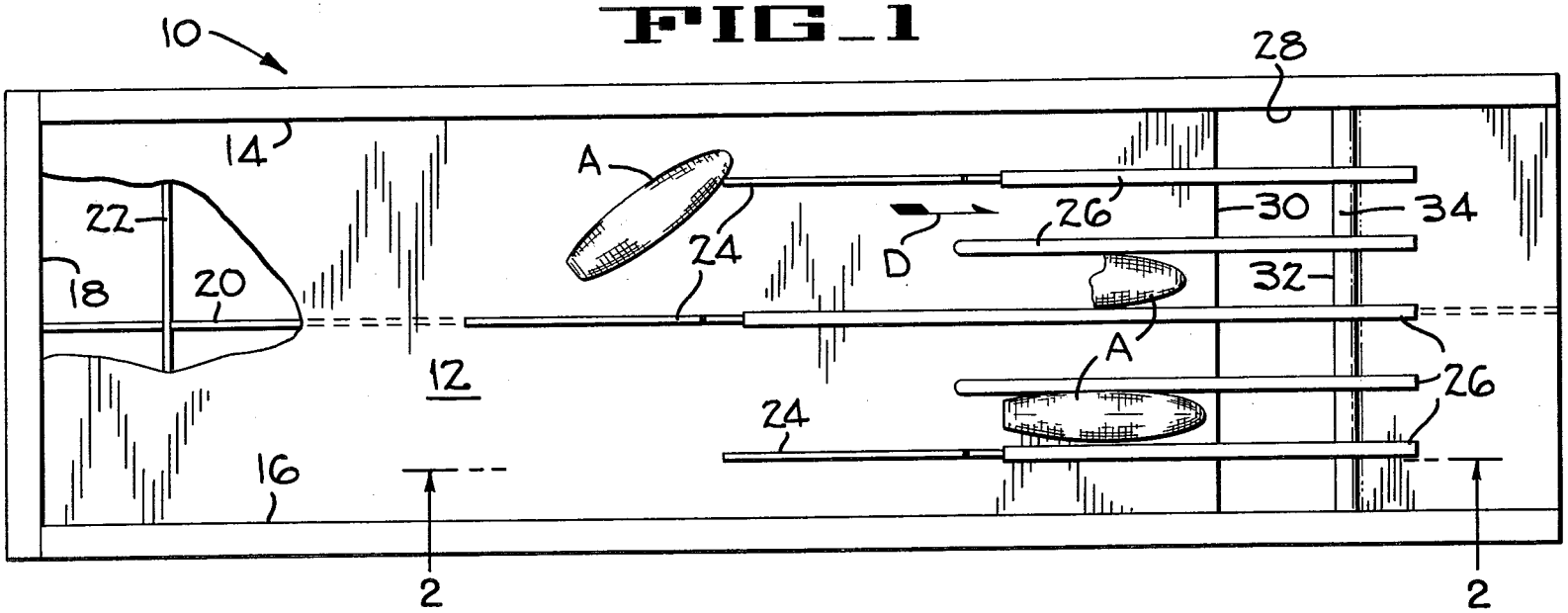
FIG. 1 is a plan view of a separator with portions broken away to show underlying structure. This separator embodies the present invention and can be used for practicing the method of separation.

Looking now at FIG. 1, a separator 10 has a vibratory surface 12 for conveying elongated articles A, such as ears of corn, longitudinally thereon in the direction indicated by the arrow D. This vibratory surface is the bottom of a pan that has a pair of longitudinal side walls 14 and 16 and a transverse end wall 18. The vibratory surface or pan bottom is stiffened on the under side thereof by longitudinal beams 20 and transverse beams 22 that project downwardly therefrom. Projecting upwardly from the vibratory surface are a series of tapered flats 24 and orienting rods 26 that extend longitudinally of the vibratory surface, parallel to the side walls 14 and 16, to define lanes within which the elongated articles A travel. The tapered flats are staggered in longitudinal location, and a flat is attached to one end of every other orienting rod. When elongated articles A contact the tapered flats and orienting rods, such articles are aligned longitudinally in the direction of travel D.

Figure 2:
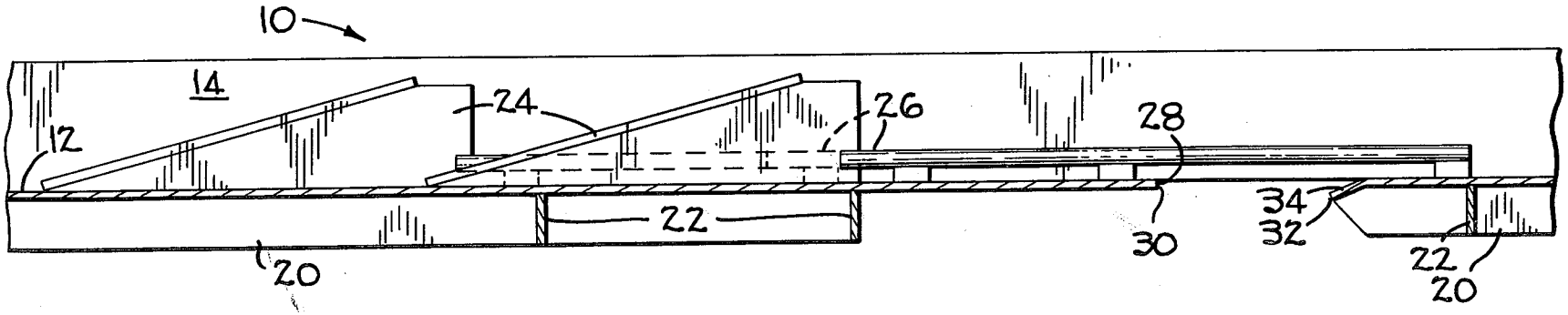
FIG. 2 is a vertical section, taken on the line 2—2 of FIG. 1, showing the vibratory surface, slot, and article orienting means.
Figure 3:
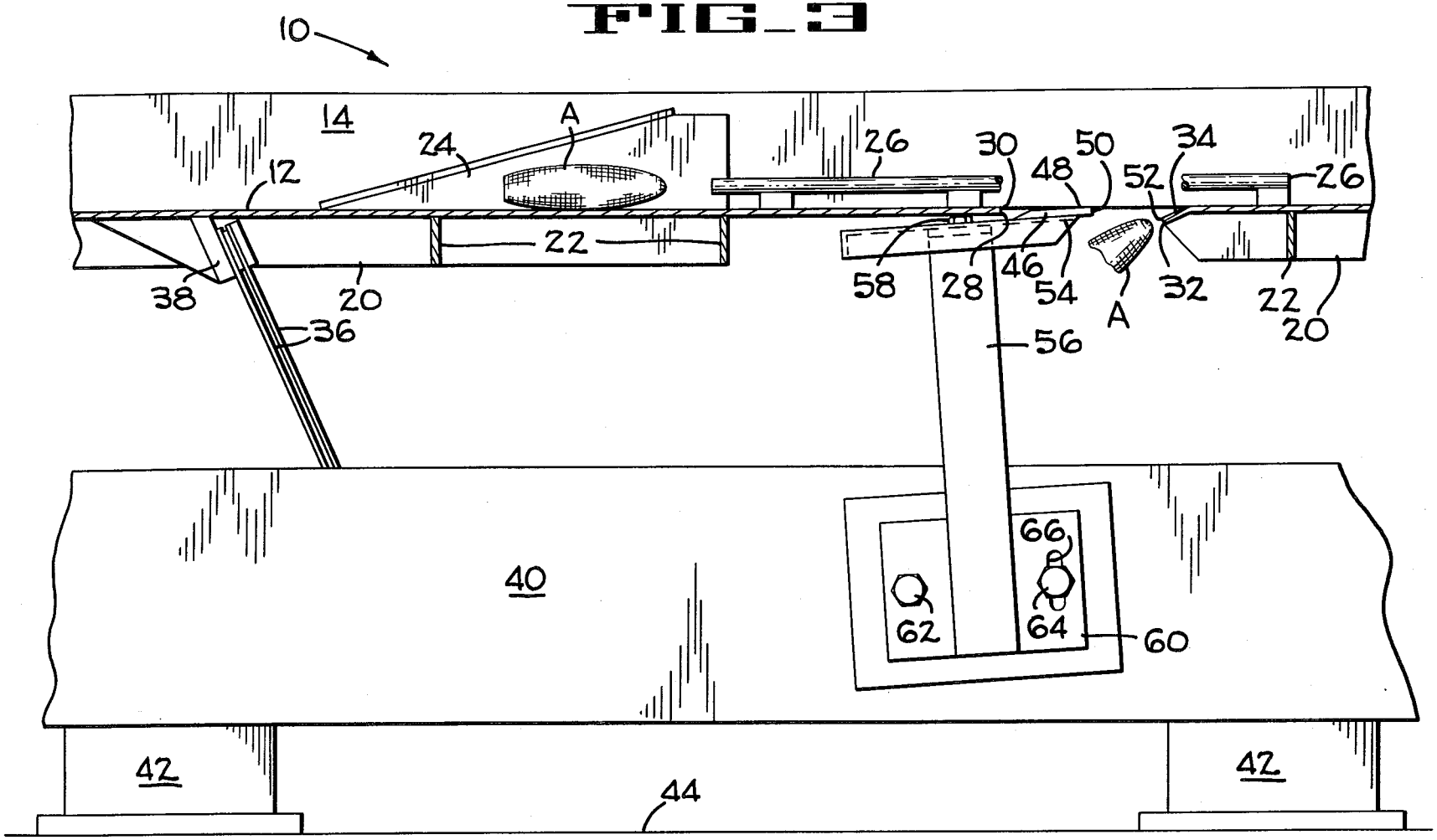
FIG. 3 is a vertical section similar to FIG. 2 showing a detail view of the plate that fits within the slot in the vibratory surface and the plate mounting on an isolated base of a vibratory conveyor.

The vibratory surface 12 has a transverse slot 28, with an upstream edge 30 and a downstream edge 32, located beneath the orienting rods 26. The downstream edge of the slot is located at the end of a lip 34 that is inclined from the horizontal downwardly, as shown in FIGS. 2 and 3, at an angle corresponding to the angle of vibration of the vibratory surface. This surface is supported by sets of leaf springs 36 that are inclined from vertical at the same angle as the lip 34 is inclined from horizontal. One end of each leaf spring set is connected by a mounting bracket 38 to the vibratory surface, while the opposite end of the leaf spring set is attached to a base 40. This base is mounted at longitudinally spaced intervals by vibration isolators 42 upon a support surface 44. A conventional exciter, not shown, can be mounted to either the vibratory surface or the base or connected therebetween in a usual manner to cause one mass to vibrate relative to the other mass, thereby actuating the two-mass system.

As shown in FIG. 3, a plate 46 projects within the slot 28 near the upstream edge 30 to form a surface 48 over which articles A must slide. This plate has a downstream edge 50 that together with the downstream edge 32 of the slot define there between a grading gap 52 through which short-length articles drop. The plate is mounted upon a frame 54 that can slide perpendicular to two posts 56 for adjusting the spacing of the grading gap when bolts 58 are loosened. The posts 56 are fixed to brackets 60 that are adjustable mounted on the base 40 by bolts 62 and 64. When these bolts are loosened, an elongated slot 66 in each bracket enables bracket, posts, frame and plate to pivot about the bolt 62 for adjusting the spacing of the grading gap.

In operation, elongated articles A, such as ears of corn, are loaded onto the vibratory surface 12 near the end wall 18 of the pan. The tapered flats 24 and orienting rods 26 align these articles as they move in the direction indicated by the arrow D towards the transverse slot 28. Since the base 40 is supported on vibration isolators 42 and the vibratory surface is supported from the base by leaf springs 36, both the base and the plate 46 move in an opposite direction of vibration (counterstroke) from the vibratory surface. The base weighs more than the pan, so the amplitude of vibration of the vibratory surface is greater than that of the plate. When articles fed by the vibratory surface encounter the plate moving in the opposite direction at a lower amplitude, the articles decelerate rapidly.

After sliding over the plate 46, short articles or nubbins tend to pitch forward and drop through the grading gap 52. If the gap is bridged by a nubbin with its leading end contacting the lip 34, when the vibratory surface 12 strokes forward and the plate strokes backward, the nubbin will slide backward through the gap. If a short ear of corn, that is larger than a nubbin, comes to rest with its leading end contacting the lip, when the plate strokes forward towards the discharge end of the pan, the short ear is dislodged and propelled forward. A regular sized article or whole ear of corn tends to span the grading gap in a generally horizontal position because that portion of the article remaining upstream from the plate's downstream edge 50 counterbalances the portion of the article projecting as a cantilever across the grading gap. Then, as the plate strokes forward, the article is pushed across the grading gap, until the article portion supported by the vibratory surface counterbalances the trailing portion of the article that extends as a cantilever across the grading gap. After that, the regular sized article is conveyed in the direction of travel D by the vibratory surface.

While only one grading gap 52 has been shown, it will be understood that multiple grading stations can be arranged in series on the vibratory surface 12 to improve the efficiency of separation at increased handling speeds.

Figure 4:
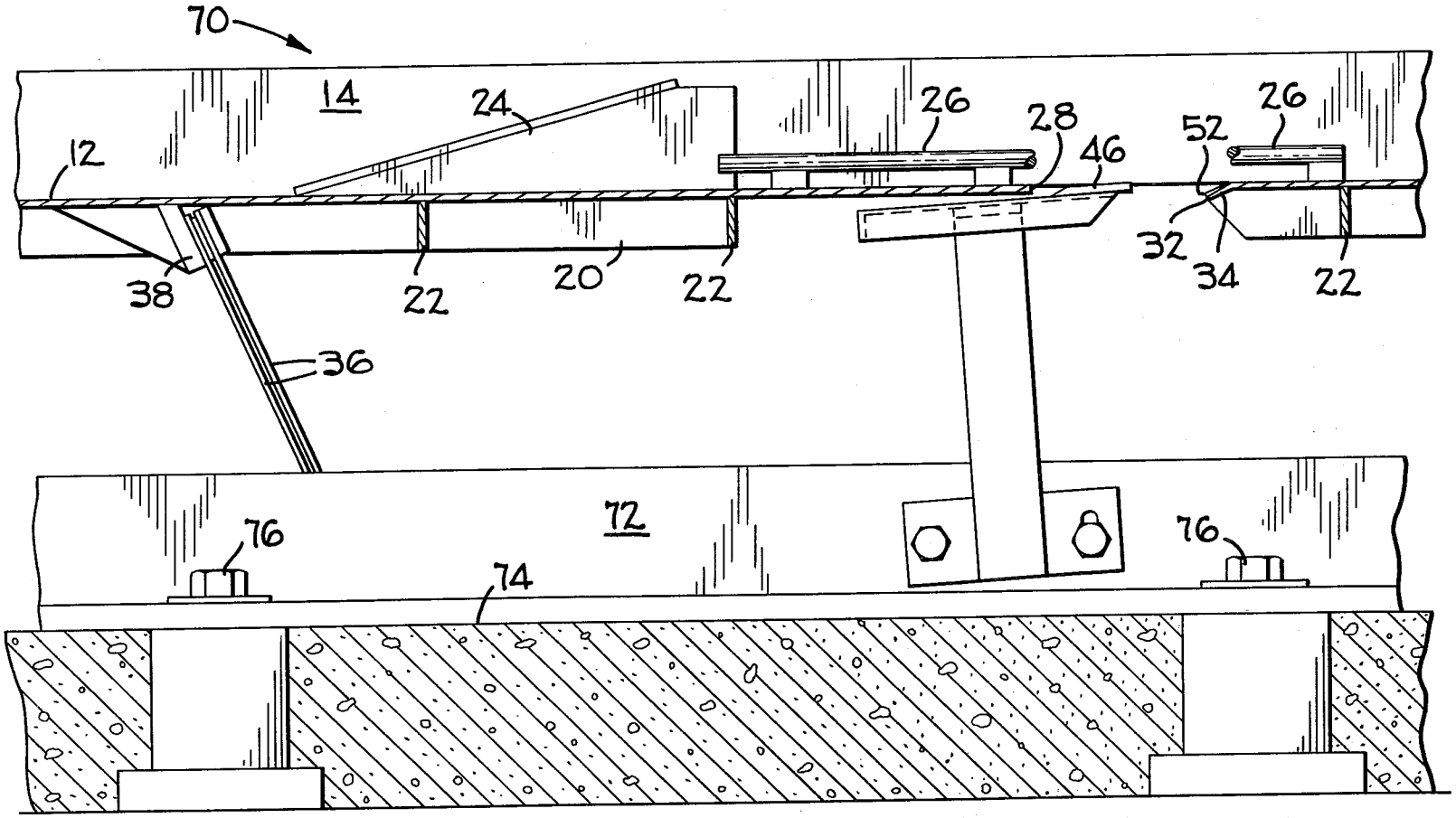
FIG. 4 is a vertical section similar to FIG. 3 showing a detail view of a plate and plate mounting on a separator having a fixed base and embodying a modified form of the invention.

With reference to FIG. 4, a modified form of the invention is shown by a separator 70 that has a base 72 fixed to a support surface 74 by anchor bolts 76. The remainder of this separator structure is similar to that previously described for the separator 10 so like parts will be given the same reference numerals. The operation of this separator is somewhat different because the plate 46 is held stationary by the fixed base. Articles A, such as ears of corn, decelerate when sliding across the stationary plate. By setting the grading gap 52 wider than that used with the isolated base 40, short articles or nubbins that project over the gap with a leading end contacting the lip 34 are rejected when the vibratory surface 12 of the pan strokes forward widening the gap. Short articles such as small ears are pushed forward on the vibratory surface when the pan moves back toward the stationary plate.

Figure 5:
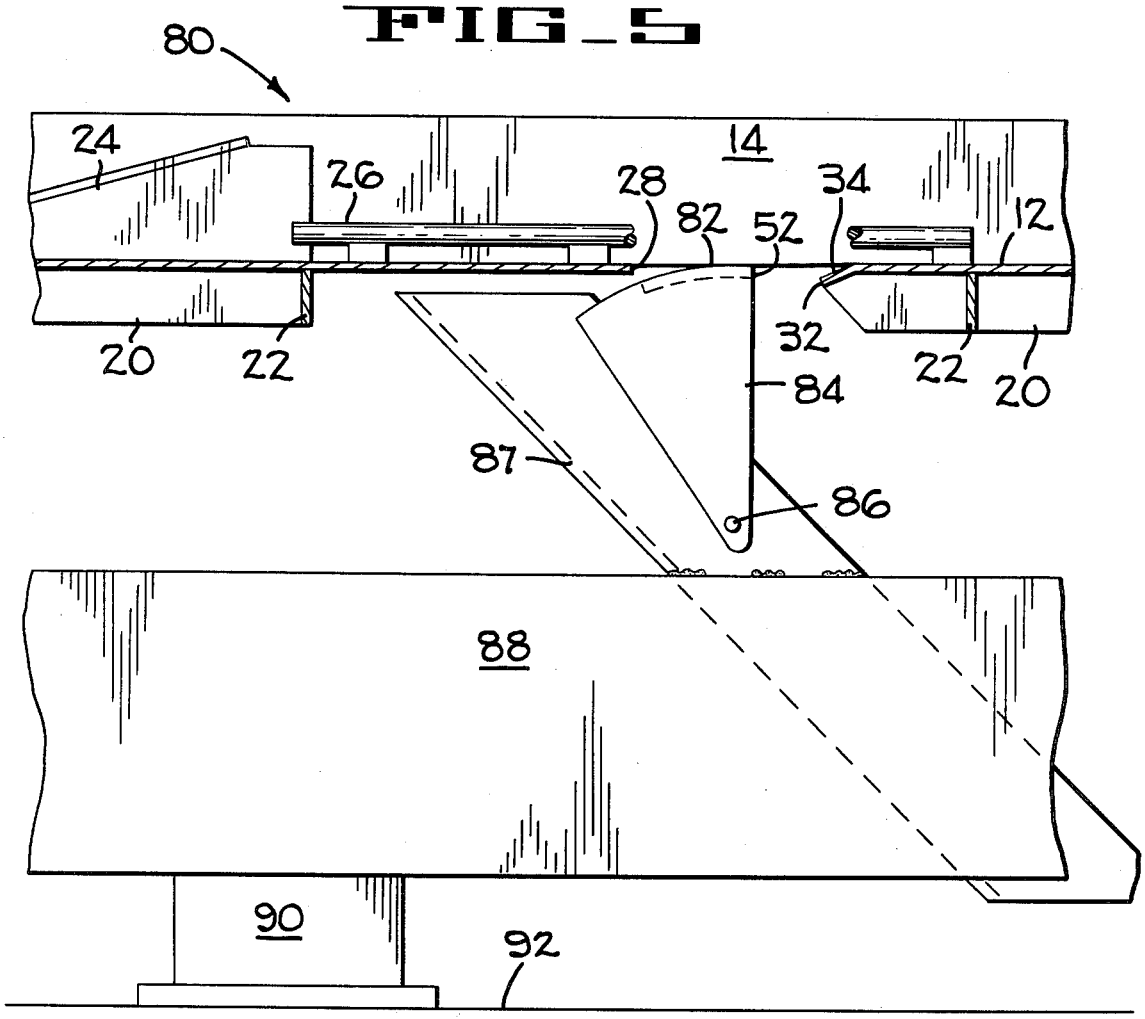
FIG. 5 is a vertical section showing a detail view of a plate with a modified form of plate mounting.

Another modification is illustrated in FIG. 5. A separator 80 has a plate 82 fixed between a pair of arms 84 that are pivotally mounted by pins 86 to a chute 87. This chute is fixed to a base 88 that is mounted by vibration isolators 90 upon a support surface 92. The arms 84 pivot about the pins 86 to adjust the width of the grading gap 52, and the arms can be locked in a desired plate position by conventional locking means, not shown. Short articles that fall through the grading gap 52 drop into the chute 87 that conveys the short articles to a suitable disposal area. Otherwise, the operation of this separator is similar to that previously described for the separator 10. If the chute 87 was mounted to a separator having a fixed base, the separator operation would be similar to that previously described for the separator 70

From the foregoing description, it will be seen that the disclosed separators can not be clogged or jammed by broken or odd shaped articles because the width of the grading gap 52 varies with the vibratory stroke to provide for self-cleaning, and very few articles of acceptable length are rejected. Better separation at larger capacities is achieved because articles A decelerate instantly before reaching the grading gap. This causes a more positive orientation at a higher initial conveying speed. By using multiple grading stations, higher efficiencies can be achieved at increased handling speeds. The width of the grading gap can be adjusted by positioning the plates 46 or 82.

Although the best mode contemplated for carrying out the present invention has been herein shown and described, it will be apparent that modification and variation may be made without departing from what is regarded to be the subject matter of the invention.

What is claimed is:

1. A separator comprising a vibratory surface for conveying elongated articles longitudinally thereon, said surface having a slot with upstream and downstream edges extending transversely of the direction of articles travel, a plate projecting within the slot near the upstream edge to form a surface over which articles slide, said plate having a downstream edge that together with the downstream edge of the slot defines a grading gap through which articles of short length drop, and means mounting the plate independently of the vibratory surface whereby articles conveyed by the surface decelerate when sliding across the plate before reaching the grading gap.

2. The separator described in claim 1 including means for orienting elongated articles longitudinally in the direction of article travel on the vibratory surface at a location upstream from the grading gap.

3. The separator described in claim 2 wherein said article orienting means includes a plurality of tapered flats extending upright from the vibratory surface at staggered longitudinal locations, and a plurality of orienting rods extending downstream from the tapered flats to define parallel lanes in which the elongated articles travel in single file relationship to the grading gap.

4. In a separator having a vibratory surface for conveying elongated articles longitudinally thereon, said surface having a slot with upstream and downstream edges extending transversely of the direction of article travel, the improvement comprising a plate projecting within the slot near the upstream edge to form a surface over which articles slide, said plate having a downstream edge that together with the downstream edge of the slot defines a grading gap through which articles of short length drop, and means mounting the plate independently of the vibratory surface whereby articles conveyed on the surface decelerate when sliding across the plate before reaching the grading gap.

5. The separator described in claim 4 wherein the vibratory surface adjacent the downstream edge of the slot has a lip that is inclined downwardly at an angle corresponding to the angle of vibration of the vibratory surface to define the downstream edge of the grading gap.

6. The separator described in claim 5 wherein said plate is adjustably mounted to vary the length of the grading gap.

7. The separator described in claim 4 wherein said plate mounting means includes a fixed base that holds the plate stationary while the vibratory surface oscillates varying the length of the grading gap with the amplitude of vibration of the vibratory surface.

8. The separator described in claim 4 wherein said plate mounting means includes an isolated base that causes the plate to vibrate in a manner counter to the vibratory surface oscillations.

9. A method for separating elongated articles of random length into articles of a least minimum length and articles of less than minimum length, said method comprising the steps of supporting random length articles of a vibratory surface having a grading gap therein, vibrating the vibratory surface to move the articles thereon towards the grading gap at a predetermined speed, orienting and aligning the articles lengthwise in the direction of travel in at least one single file row, decelerating the articles from the predetermined speed of travel before the articles reach the grading gap, causing articles of minimum length to pass over the grading gap, and causing articles of short length to drop by gravity through the grading gap.

10. The method described in claim 9 including the step of varying the length of the gap at the frequency of vibration of the vibratory surface to prevent jamming of articles therein.

* * * * *